US008669753B2

(12) United States Patent
Heng

(10) Patent No.: US 8,669,753 B2
(45) Date of Patent: Mar. 11, 2014

(54) VOLTAGE REGULATOR HAVING A PHASE COMPENSATION CIRCUIT

(75) Inventor: Socheat Heng, Chiba (JP)

(73) Assignee: Seiko Instruments Inc. (JP)

( * ) Notice: Subject to any disclaimer, the term of this patent is extended or adjusted under 35 U.S.C. 154(b) by 144 days.

(21) Appl. No.: 13/289,570

(22) Filed: Nov. 4, 2011

(65) Prior Publication Data

US 2012/0146603 A1 Jun. 14, 2012

(30) Foreign Application Priority Data

Dec. 9, 2010 (JP) ..... 2010-275000

(51) Int. Cl.
*G05F 1/67* (2006.01)
*G05F 1/70* (2006.01)

(52) U.S. Cl.
USPC ..... 323/312; 323/282

(58) Field of Classification Search
USPC ..... 323/311–317, 282
See application file for complete search history.

(56) References Cited

U.S. PATENT DOCUMENTS 7,173,481 B2 * 2/2007 Kimura ..... 327/541
8,436,597 B2 * 5/2013 Sicard ..... 323/280
2012/0146603 A1 * 6/2012 Heng ..... 323/282
2012/0194147 A1 * 8/2012 Socheat ..... 323/265
2012/0200283 A1 * 8/2012 Socheat ..... 323/316
2012/0242312 A1 * 9/2012 Heng ..... 323/282
2012/0249104 A1 * 10/2012 Heng ..... 323/282
2012/0249117 A1 * 10/2012 Heng ..... 323/313
2013/0033247 A1 * 2/2013 Endo et al. ..... 323/282

OTHER PUBLICATIONS

Milliken, Robert J. et al., "Full On-Chip CMOS Low-Dropout Voltage Regulator," IEEE Transactions on Circuits and Systems—I: Regular Papers, vol. 54, No. 9, Sep. 2007, pp. 1879-1890.

* cited by examiner

*Primary Examiner* — Adolf Berhane
*Assistant Examiner* — Nusrat Quddus
(74) *Attorney, Agent, or Firm* — Brinks Gilson & Lione

(57) ABSTRACT

Provided is a voltage regulator including a phase compensation circuit capable of obtaining an accurate output voltage. The phase compensation circuit includes: a first constant current circuit connected to a gate of an output transistor; a first transistor having a drain connected to the gate of the output transistor; and a second transistor having a drain connected to a gate of the first transistor, a second constant current circuit, and a resistor and having a gate connected to the resistor and any one terminal of a first capacitor, the first capacitor having the other terminal connected to an output terminal of the voltage regulator. This configuration prevents a current from flowing from an output terminal of the differential amplifier circuit to the drain of the first transistor, to thereby reduce an offset voltage to be generated in input transistors of the differential amplifier circuit, thus obtaining an accurate output voltage.

4 Claims, 5 Drawing Sheets

VOLTAGE REGULATOR HAVING A PHASE COMPENSATION CIRCUIT

RELATED APPLICATIONS

This application claims priority under 35 U.S.C. §119 to Japanese Patent Application No. 2010-275000 filed on Dec. 9, 2010, the entire content of which is hereby incorporated by reference.

BACKGROUND OF THE INVENTION

1. Field of the Invention

The present invention relates to a phase compensation circuit of a voltage regulator.

2. Description of the Related Art

A conventional voltage regulator is described. FIG. 4 is a circuit diagram illustrating the conventional voltage regulator.

The conventional voltage regulator includes a reference voltage circuit 101, a differential amplifier circuit 102, a PMOS transistor 106, a phase compensation circuit 460, resistors 108 and 109, a ground terminal 100, an output terminal 121, and a power supply terminal 150. The phase compensation circuit 460 includes a constant current circuit 405, NMOS transistors 401, 406, 403, and 408, capacitors 402 and 407, and a resistor 404. The differential amplifier circuit 102 is formed by a single-stage amplifier as illustrated in FIG. 5.

Connection in the conventional voltage regulator is described. The differential amplifier circuit 102 has an inverting input terminal connected to any one terminal of the reference voltage circuit 101, a non-inverting input terminal connected to a connection point between any one terminal of the resistor 108 and any one terminal of the resistor 109, and an output terminal connected to a gate of the PMOS transistor 106 and a drain of the NMOS transistor 401. The other terminal of the reference voltage circuit 101 is connected to the ground terminal 100. The NMOS transistor 401 has a source connected to a drain of the NMOS transistor 403 and the capacitor 402, and has a gate connected to a gate and a drain of the NMOS transistor 406. The NMOS transistor 403 has a source connected to the ground terminal 100, and has a gate connected to any one terminal of the resistor 404 and a drain of the NMOS transistor 408. The NMOS transistor 408 has a source connected to the ground terminal 100, a gate connected to the other terminal of the resistor 404 and a connection point between any one terminal of the capacitor 402 and any one terminal of the capacitor 407, and a drain connected to a source of the NMOS transistor 406. The NMOS transistor 406 has the drain connected to any one terminal of the constant current circuit 405. The other terminal of the constant current circuit 405 is connected to the power supply terminal 150. The PMOS transistor 106 has a source connected to the power supply terminal 150, and has a drain connected to the output terminal 121, the other terminal of the capacitor 407, and the other terminal of the resistor 108. The other terminal of the resistor 109 is connected to the ground terminal 100. (See, for example, IEEE TRANSACTIONS ON CIRCUITS AND SYSTEMS-I: REGULAR PAPERS, VOL. 54, NO. 9, SEPTEMBER 2007 (FIG. 13).)

In the conventional technology, however, the phase compensation circuit 460 is configured to cause a part of current of the output terminal of the differential amplifier circuit 102 to flow into the ground. Accordingly, there has been a problem that a current flows from a transistor 503 of the differential amplifier circuit 102 to the output, and the balance between currents flowing through input transistors 501 and 504 is lost to cause an offset, with the result that an accurate output voltage becomes difficult to obtain.

SUMMARY OF THE INVENTION

The present invention has been made in view of the above-mentioned problem, and provides a voltage regulator including a phase compensation circuit capable of obtaining an accurate output voltage.

A voltage regulator according to the present invention includes: an output transistor; a phase compensation circuit; and a single-stage differential amplifier circuit for amplifying and outputting a difference between a divided voltage obtained by dividing a voltage output by the output transistor and a reference voltage of a reference voltage circuit, to thereby control a gate of the output transistor, in which the phase compensation circuit includes: a first constant current circuit connected to the gate of the output transistor; a first transistor including a drain connected to the gate of the output transistor; and a second transistor including a drain connected to a gate of the first transistor, a second constant current circuit, and a resistor, and including a gate connected to the resistor and any one terminal of a first capacitor, the first capacitor including another terminal connected to an output terminal of the voltage regulator.

According to the voltage regulator including the phase compensation circuit of the present invention, an accurate output voltage can be obtained without generating an offset caused by losing the balance between currents flowing through input transistors of the differential amplifier circuit. Besides, stable and high-speed operation can be attained independently of an output capacitor and an output resistor.

DETAILED DESCRIPTION OF THE PREFERRED EMBODIMENTS

Figure 1:
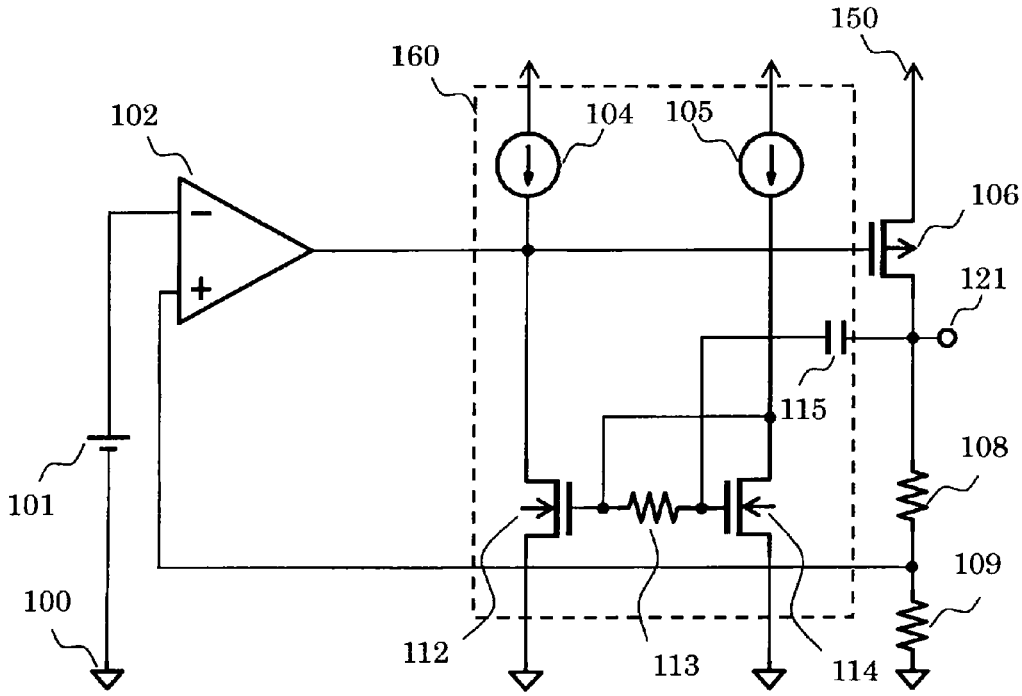
FIG. 1 is a circuit diagram illustrating a voltage regulator according to a first embodiment of the present invention.

FIG. 1 is a circuit diagram of a voltage regulator according to a first embodiment of the present invention.

Figure 5:
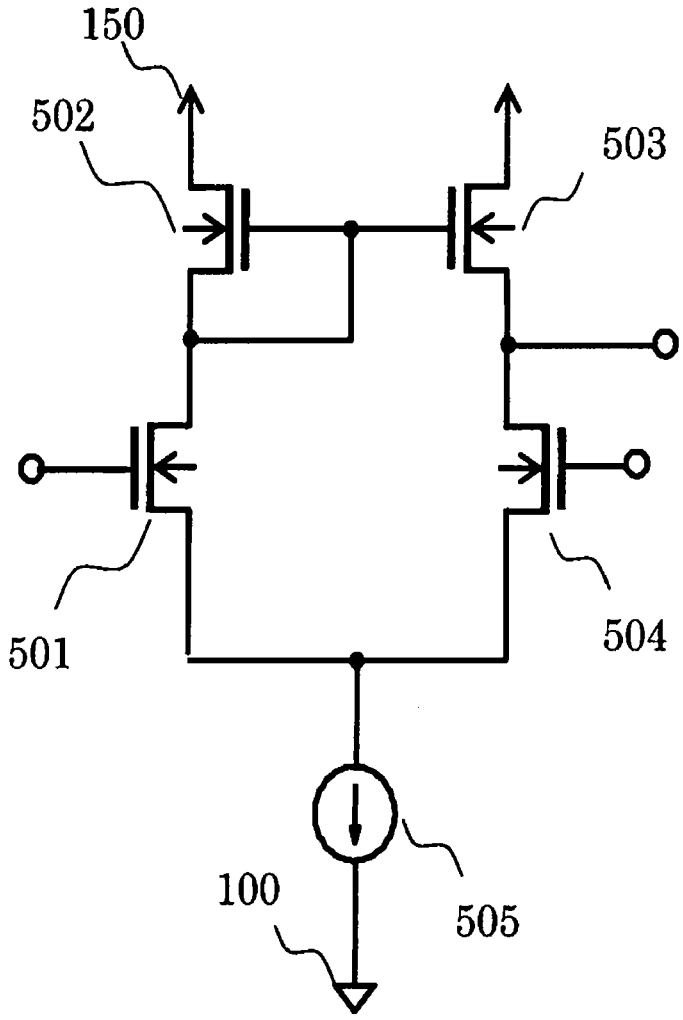
FIG. 5 PRIOR ART
FIG. 5 is a circuit diagram illustrating a differential amplifier circuit formed by a single-stage amplifier.

The voltage regulator according to the first embodiment includes a reference voltage circuit 101, a differential amplifier circuit 102, a phase compensation circuit 160, a PMOS transistor 106, resistors 108 and 109, a ground terminal 100, an output terminal 121, and a power supply terminal 150. The phase compensation circuit 160 includes NMOS transistors 112 and 114, a capacitor 115, a resistor 113, and constant current circuits 104 and 105. The differential amplifier circuit 102 is formed by a single-stage amplifier as illustrated in FIG. 5.

Next, connection of component circuits of the voltage regulator according to the first embodiment is described.

The differential amplifier circuit 102 has an inverting input terminal connected to any one terminal of the reference voltage circuit 101, a non-inverting input terminal connected to a connection point between any one terminal of the resistor 108 and any one terminal of the resistor 109, and an output terminal connected to a gate of the PMOS transistor 106, a drain of the NMOS transistor 112, and any one terminal of the constant current circuit 104. The other terminal of the reference voltage circuit 101 is connected to the ground terminal 100. The NMOS transistor 112 has a source connected to the ground terminal 100, and has a gate connected to any one terminal of the resistor 113 and a drain of the NMOS transistor 114. The NMOS transistor 114 has a gate connected to the other terminal of the resistor 113 and any one terminal of the capacitor 115, a drain connected to any one terminal of the constant current circuit 105, and a source connected to the ground terminal 100. The other terminal of each of the constant current circuits 104 and 105 is connected to the power supply terminal 150. The PMOS transistor 106 has a source connected to the power supply terminal 150, and has a drain connected to the output terminal 121, the other terminal of the capacitor 115, and the other terminal of the resistor 108. The other terminal of the resistor 109 is connected to the ground terminal 100.

Next, an operation of the voltage regulator according to the first embodiment is described.

The resistors 108 and 109 output a divided voltage Vfb by dividing an output voltage Vout, which is a voltage at the output terminal 121. The differential amplifier circuit 102 has a single-stage amplifier configuration, and compares the divided voltage Vfb with an output voltage Vref of the reference voltage circuit 101 to control a gate voltage of the output transistor 106 so that the output voltage Vout becomes constant. When the output voltage Vout is higher than a predetermined voltage, the divided voltage Vfb is higher than the reference voltage Vref. Then, an output signal of the differential amplifier circuit 102 (gate voltage of the output transistor 106) becomes higher to gradually turn OFF the output transistor 106, and the output voltage Vout decreases. In this way, the output voltage Vout is controlled to be constant. On the other hand, when the output voltage Vout is lower than the predetermined voltage, an operation reverse to the above-mentioned operation is performed to increase the output voltage Vout. In this way, the voltage regulator according to the first embodiment controls the output voltage Vout to be constant.

Here, in the voltage regulator according to the first embodiment, poles occur at frequencies expressed by Expressions (1) and (2) below having the phase compensation circuit 160.

$$fp1 = \frac{1}{2\pi\{R_1 Gm_{P106} R_{out}(Gm_{N114} R_{113} C_{115})\}} \quad (1)$$

$$fp2 = \frac{Gm_{P106}(Gm_{N114} R_{113} C_{115})}{2\pi C_{out} C_G} \quad (2)$$

where $R_1$ is a parasitic resistance component of output impedance of the differential amplifier circuit 102, $R_{out}$ is a resistance of a load resistor connected to the output terminal 121, $Gm_{P106}$ is a transconductance of the PMOS transistor 106, $Gm_{N114}$ is a transconductance of the NMOS transistor 114, $R_{113}$ is a resistance of the resistor 113, $C_{115}$ is a capacitance of the capacitor 115, $C_{out}$ is a capacitance of a connected output capacitor, and $C_G$ is a gate capacitance of the PMOS transistor 106.

As understood from Expressions (1) and (2), the positions of the first pole and the second pole can be adjusted by the resistance of the resistor 113, the capacitance of the capacitor 115, and the transconductance of the NMOS transistor 114, and therefore can be adjusted so as to attain stable operation independently of the values of the output resistor $R_{out}$ and the output capacitor $C_{out}$.

The output terminal of the differential amplifier circuit 102 is connected to the drain of the NMOS transistor 112 and the constant current circuit 104, and hence a current flowing into the NMOS transistor 112 can be supplied from the constant current circuit 104. Then, no current flows from the output terminal of the differential amplifier circuit 102 to the NMOS transistor 112, and hence no offset is generated in input-stage transistors of the differential amplifier circuit 102. This configuration eliminates fluctuations in output voltage caused by the offset, thus enabling setting of an accurate output voltage.

Note that, as an alternative to the constant current circuits 104 and 105, a current mirror circuit may be used to supply currents from another constant current source.

In this way, the offset to be generated in the differential amplifier circuit 102 can be reduced to suppress the fluctuations in output voltage. Then, stable operation can be attained independently of the output resistor and the output capacitor.

Figure 2:
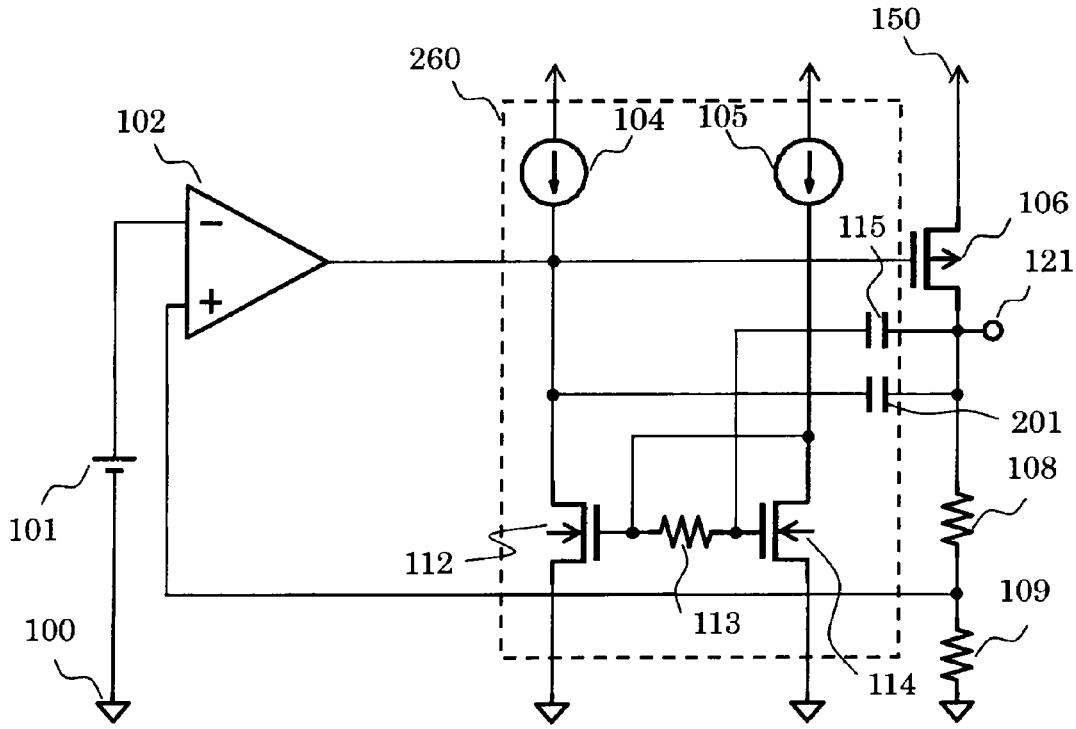
FIG. 2 is a circuit diagram illustrating a voltage regulator according to a second embodiment of the present invention.

FIG. 2 is a circuit diagram of a voltage regulator according to a second embodiment of the present invention. A phase compensation circuit 260 included in the voltage regulator according to the second embodiment further includes a capacitor 201. The capacitor 201 is connected between the drain of the NMOS transistor 112 and the output terminal 121.

The capacitor 201 can shift the poles that occur by the transconductance of the NMOS transistor 114 to a higher frequency region. Therefore, the phase of the voltage regulator can be adjusted independently of the values of the output resistor $R_{out}$ and the output capacitor $C_{out}$.

Therefore, the voltage regulator according to the second embodiment can perform more stable operation by including the capacitor 201.

Figure 3:
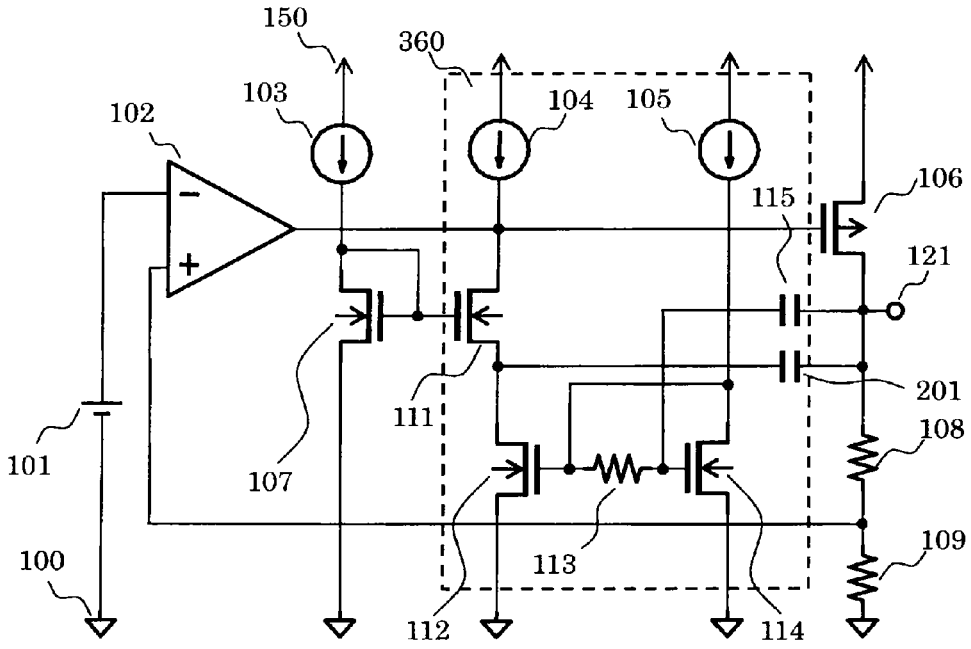
FIG. 3 is a circuit diagram illustrating a voltage regulator according to a third embodiment of the present invention.
Figure 4:
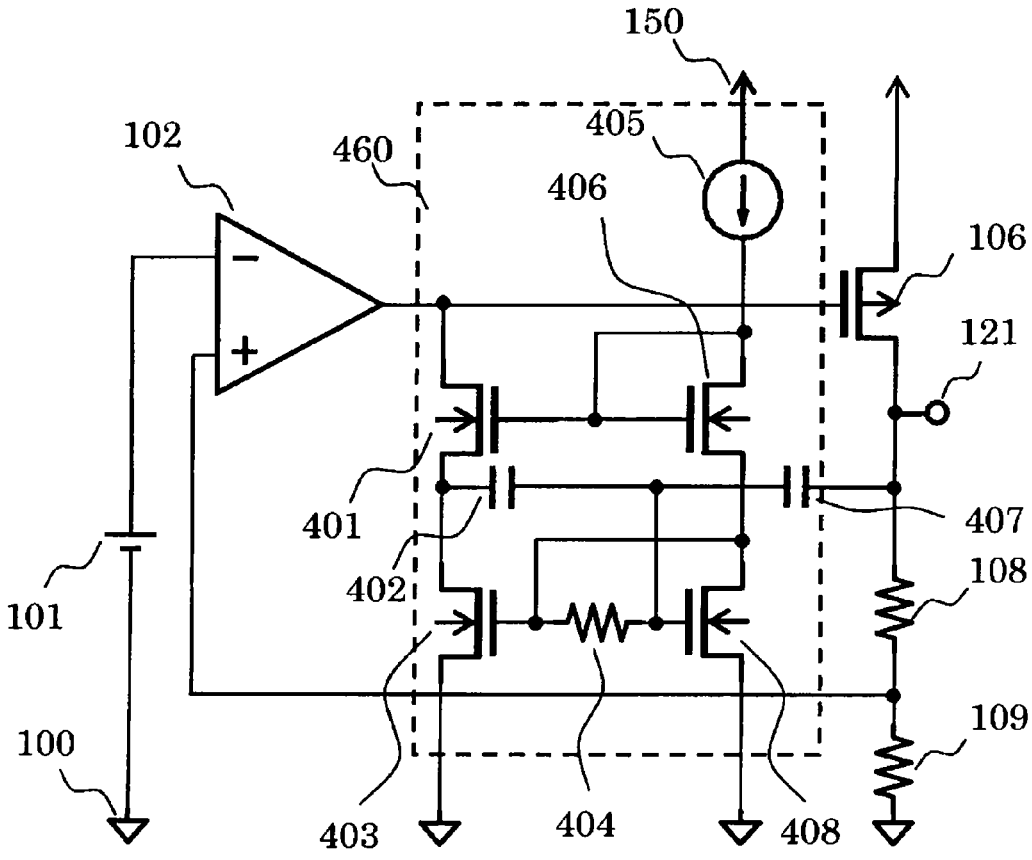
FIG. 4 PRIOR ART
FIG. 4 is a circuit diagram illustrating a conventional voltage regulator.

FIG. 3 is a circuit diagram of a voltage regulator according to a third embodiment of the present invention. A phase compensation circuit 360 included in the voltage regulator according to the third embodiment is additionally provided with an NMOS transistor 111 as a cascode transistor between the constant current circuit 104 and the drain of the NMOS transistor 112. The constant current circuit 103 and the NMOS transistor 107 together form a circuit for applying a bias voltage to a gate of the NMOS transistor 111.

The constant current circuit 103 has any one terminal connected to the power supply terminal 150 and the other terminal connected to the drain of the NMOS transistor 107. The NMOS transistor 107 has a source connected to the ground terminal 100, and has a gate and a drain which are connected to the gate of the NMOS transistor 111. The NMOS transistor 111 has a source connected to a connection point between the drain of the NMOS transistor 112 and the capacitor 201, and has a drain connected to the output terminal of the differential amplifier circuit 102.

The NMOS transistor 111 operates as a cascode transistor and is capable of reducing the influence of channel length modulation that occurs in the NMOS transistor 112. Note that, the NMOS transistor 111 that operates as a cascode transistor may be connected to the drain of NMOS transistor 114.

As described above, according to the voltage regulator of the first embodiment, the offset to be generated in the differential amplifier circuit 102 can be reduced to suppress the fluctuations in output voltage. Further, according to the voltage regulator of the second embodiment, the poles that occur by the transconductance of the NMOS transistor 114 can be shifted to a higher frequency region, to thereby adjust the phase so as to attain more stable operation. Still further, according to the voltage regulator of the third embodiment, the influence of channel length modulation that occurs in the NMOS transistor 112 can be reduced.

Note that, each of the constant current circuits 104 and 105 may be formed by an N-channel depletion transistor whose gate and source are connected to each other, and may be a P-channel depletion transistor similarly.

Further, the constant current circuit 103 and the NMOS transistor 107 may not be provided as a bias circuit. A bias voltage may be supplied from another circuit. In this case, the NMOS transistor 111 as a cascode transistor is designed to an appropriate size.

What is claimed is:

1. A voltage regulator, comprising:

a single-stage differential amplifier circuit for amplifying and outputting a difference between a reference voltage and a divided voltage obtained by dividing a voltage output by an output transistor, to thereby control a gate of the output transistor; and a phase compensation circuit, wherein the phase compensation circuit comprises:

a first constant current circuit connected between a power supply terminal and an output terminal of the single-stage differential amplifier circuit;

a first transistor including a drain connected to the output terminal of the single-stage differential amplifier circuit;

a second transistor including a drain connected to a gate of the first transistor, and a gate connected to the gate of the first transistor via a resistor;

a second constant current circuit connected to the drain of the second transistor; and a first capacitor connected between the gate of the second transistor and a drain of the output transistor.

2. A voltage regulator according to claim 1, wherein the phase compensation circuit further comprises a second capacitor connected between the drain of the first transistor and the drain of the output transistor.

3. A voltage regulator according to claim 1, wherein the phase compensation circuit further comprises a cascode transistor provided to one of the drain of the first transistor and the drain of the second transistor.

4. A voltage regulator according to claim 2, wherein the phase compensation circuit further comprises a cascode transistor provided to one of the drain of the first transistor and the drain of the second transistor.

* * * * *